US006035790A

United States Patent [19]

Polando

[11] Patent Number: 6,035,790

[45] Date of Patent: Mar. 14, 2000

[54] SHIPPING SKID

[76] Inventor: Benjamin F. Polando, 4601 Clipper Dr., Discovery Bay, Calif. 94514

[21] Appl. No.: 09/216,896

[22] Filed: Dec. 18, 1998

[51] Int. Cl.[7] ..... B65D 19/44

[52] U.S. Cl. ..... 108/55.1; 108/57.16

[58] Field of Search ..... 108/55.1, 55.5, 108/51.11, 57.15, 57.16

[56] References Cited

U.S. PATENT DOCUMENTS

| | | | |
|---|---|---|---|
| 2,890,849 | 6/1959 | Fogerty et al. | 108/57.15 |
| 2,949,863 | 8/1960 | Cozzoli | 108/57.15 X |
| 3,770,186 | 11/1973 | Kupersmit | 108/55.1 X |
| 5,505,140 | 4/1996 | Wittmann | 108/55.1 X |
| 5,529,185 | 6/1996 | Alspach et al. | 108/55.5 X |
| 5,579,700 | 12/1996 | Nuechterlein et al. | 108/55.1 |
| 5,639,174 | 6/1997 | Gonska | 108/55.1 X |
| 5,722,328 | 3/1998 | Darby | 108/55.1 |
| 5,769,376 | 6/1998 | Bostic et al. | 108/55.1 X |
| 5,809,906 | 9/1998 | Janek | 108/55.1 X |
| 5,911,179 | 6/1999 | Spiczka | 108/57.16 X |

*Primary Examiner*—Jose V. Chen
*Attorney, Agent, or Firm*—Limbach & Limbach L.L.P.

[57] ABSTRACT

A shipping skid, for shipping a shipping article that is mounted on front and rear sets of wheels, which includes a base member, elongated skid members attached to the bottom surface of the base member, a center platform attached to a top surface of the base member, and a pair of side platforms attached to the top surface of the base member so that the center platform is disposed between the side platforms. The center platform has a raised upper surface that extends higher above the base member top surface than upper surfaces of the pair of side platforms. Each of the side platforms includes a front ramp section that slopes downwardly toward the base member front end, and a back ramp section that slopes downwardly toward the base member back end. A shipping article with front and rear sets of wheels can be mounted on the skid by rolling the front set of wheels up the front ramp sections, along the top surfaces of the side platforms, and down the back ramp sections before the rear set of wheels roll up the front ramp sections, so that a bottom surface of the shipping article lowers down and engages the raised center platform. A main ramp is used to wheel the article onto the shipping skid. The main ramp supports the rear set of wheels after the front set of wheels has traversed down the rear ramp sections, so that when the main ramp is lifted and removed, the rear set of wheels are lowered to fully engage the article's bottom surface onto the raised center platform.

12 Claims, 5 Drawing Sheets

SHIPPING SKID

FIELD OF THE INVENTION

The present invention relates to shipping skids, and more particularly to an improved shipping skid for easy mounting and securing of shipping articles thereto.

BACKGROUND OF THE INVENTION

Shipping skids are well known in the art, and include a base platform onto which articles to be shipped are placed. Elongated skid members support the platform from underneath so that the prongs of a fork lift can be inserted between the skid members and engage the underside of the platform for picking up and moving the skid. Four side walls and a lid can be attached to the shipping skid to form a shipping container.

Many heavy articles, such as large electrical power supplies, are mounted on wheels so that they can be moved easily. However, when articles are shipped using commercial carriers, they need to be placed on skids so that they can be picked up and moved by fork lifts. It can be very difficult to load heavy articles up onto shipping skids, even if the heavy articles are mounted on wheels. Not only does such an article have to be lifted up onto the skid platform, but then the article needs to be securely fastened to the skid so it will not roll off. Further, many such articles are fragile and need to be protected from external shocks and vibrations that occur during shipment. While it is known to place a ramp onto the skid platform and wheel the article up onto the skid, cumbersome fixing regimes are then required to keep the article from rolling off the skid, and to protect the article from external shocks and vibrations.

There is a need for a simplified skid that can quickly receive, mount to, and protect a shipping article that has wheels on its bottom surface.

SUMMARY OF THE INVENTION

The present invention solves the aforementioned problems by providing a skid that automatically engages the bottom surface of a shipping article as the article is rolled up onto the skid.

The shipping skid of the present invention includes a base member, elongated skid members attached to a bottom surface of the base member, a center platform attached to a top surface of the base member, and a pair of side platforms attached to the top surface of the base member with the center platform disposed therebetween. The center platform has an upper surface that extends higher above the base member top surface than the upper surfaces of the pair of side platforms. Each of the side platforms have opposing ends that each have a ramp section that slopes downwardly toward the base member.

In another aspect of the present invention, the shipping skid (for shipping a shipping article that is mounted on front and rear sets of wheels) includes a base member with front and back ends, elongated skid members attached to a bottom surface of the base member, a center platform attached to a top surface of the base member and having opposing front and back edges and opposing side edges, and a pair of side platforms attached to the top surface of the base member each extending along one of the center platform side edges so that the center platform is disposed between the side platforms. The center platform has a raised upper surface that extends higher above the base member top surface than upper surfaces of the pair of side platforms. Each of the side platforms includes a front ramp section that slopes downwardly toward the base member front end, and a back ramp section that slopes downwardly toward the base member back end. A shipping article with front and rear sets of wheels can be mounted on the skid by rolling the front set of wheels up the front ramp sections, along the top surfaces of the side platforms, and down the back ramp sections before the rear set of wheels roll up the front ramp sections, so that a bottom surface of the shipping article lowers down and engages the raised center platform.

Other objects and features of the present invention will become apparent by a review of the specification, claims and appended figures.

DETAILED DESCRIPTION OF THE PREFERRED EMBODIMENTS

The present invention is a shipping skid, whereby a heavy article having wheels can be rolled up onto, and securely supported and protected by, the skid.

Figure 1:
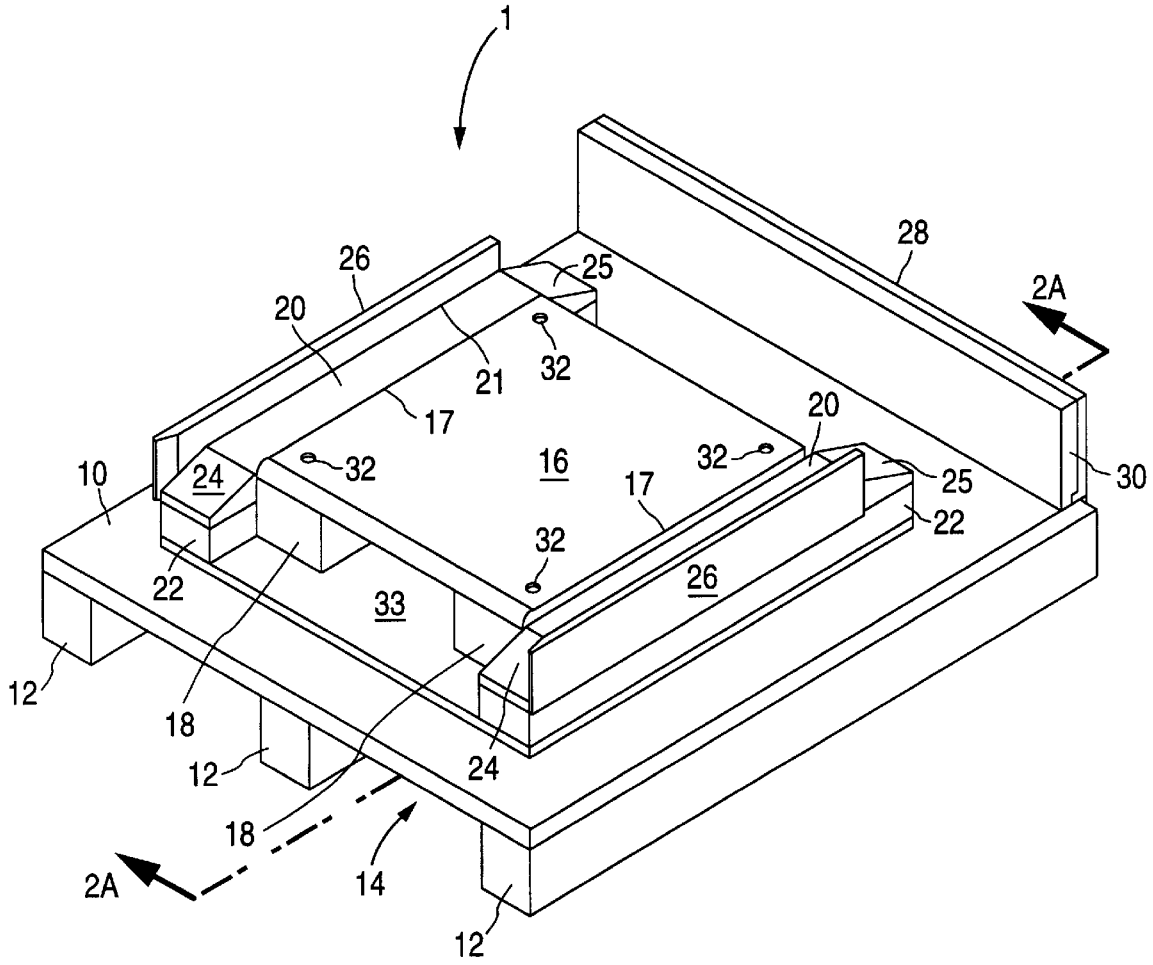
FIG. 1 is a perspective view of the shipping skid of the present invention.

The skid 1 of the present invention is illustrated in FIG. 1, and includes a base 10 supported by elongated skid members 12 to provide access areas 14 underneath base 10 so that forklift prongs can pick up and move the skid 1.

A center platform 16 is mounted to the top surface of base 10 via elastic members 18. A pair of side platforms 20 are mounted to the top surface of base 10, with the center platform 16 disposed therebetween, via elastic members 22. Each side platform 20 has front and rear opposing ends that terminate in downwardly sloping front/rear ramp sections 24/25 that face the front and rear sides of the skid 1. The center platform 16, elastic members 18, side platforms 20 and elastic members 22 are dimensioned so that the upper surface of center platform 16 is higher above base 10 than the upper surfaces of side platforms 20.

The preferred embodiment also includes a pair of side rails 26 that are attached along the outer edges 21 of side platforms 20, and oriented parallel to and opposing the side edges 17 of center platform 16. A stop member 28 with an elastic member 30 is attached to the rear edge of base 10 and extends above the upper surface of base 10. Anchor holes 32, such as bolt holes with T-nut assemblies to receive and tighten bolts to the platform, are formed in the top surface of the center platform 16. In the preferred embodiment, the elastic members 18 and 22 are attached to a plate member 33, which in turn is attached to base 10, for increasing the stability and strength of skid 1.

Figure 2A:
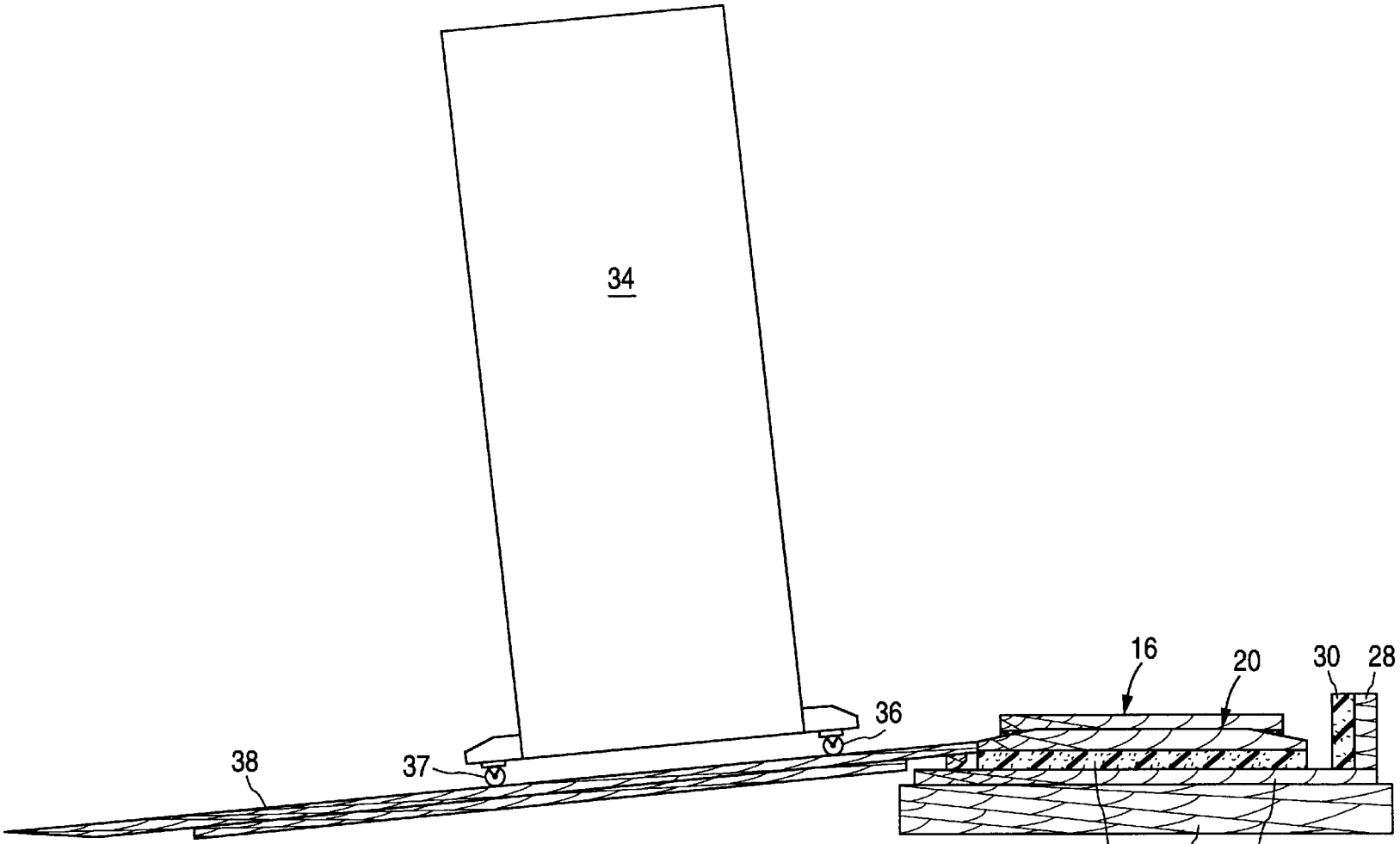
FIG. 2A is a side view illustrating the loading of a shipping article up onto the shipping skid of the present invention.
Figure 2B:
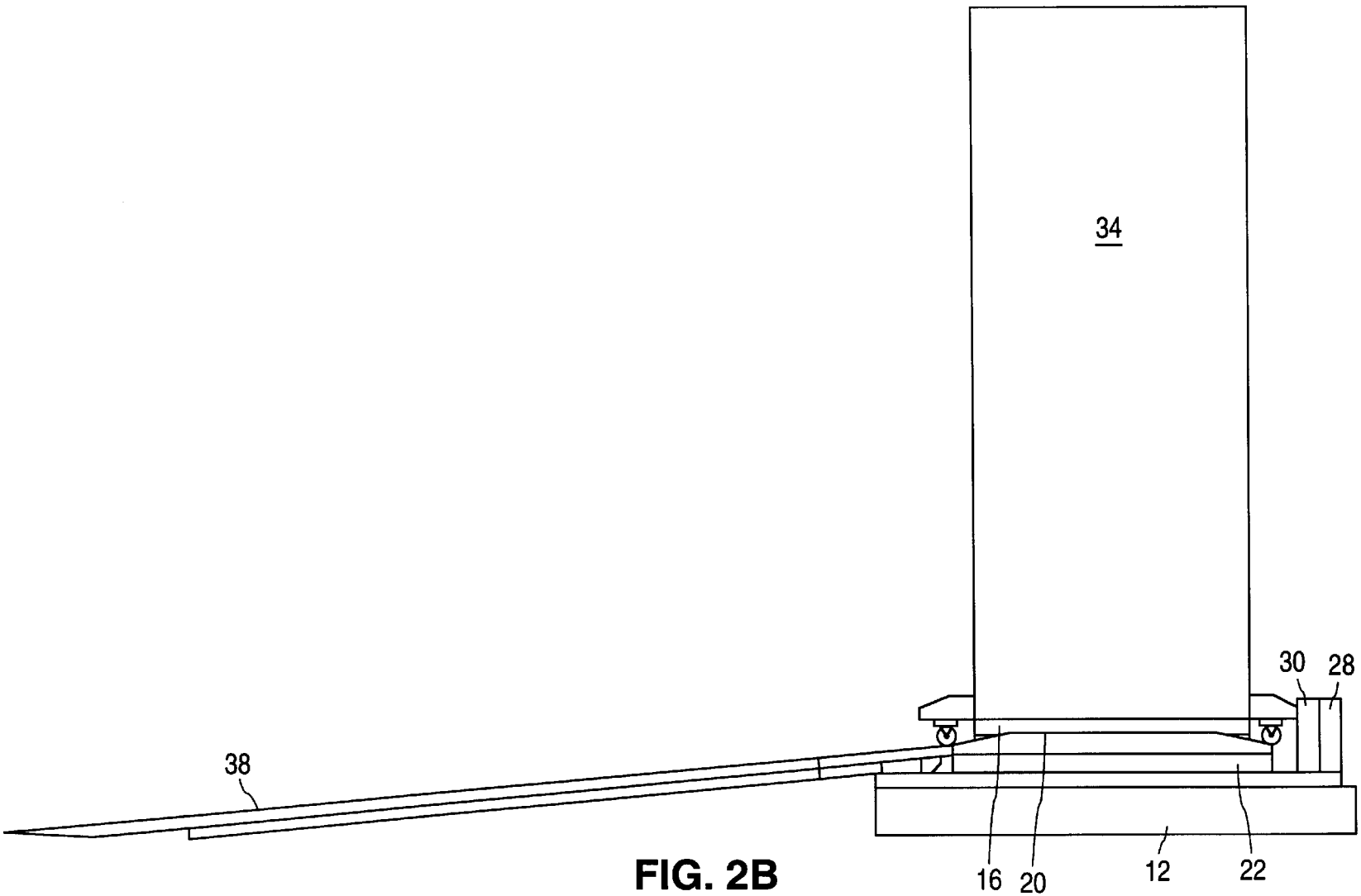
FIG. 2B is a side view illustrating a shipping article loaded onto the shipping skid of the present invention.

FIG. 2A illustrates an article 34, which has leading and trailing sets of wheels 36/37 attached to its bottom surface, that is to be shipped using skid 1 of the present invention. A ramp 38 is used to wheel the article up onto skid 1, where the leading set of wheels 36 roll up ramp sections 24 and along side platforms 20. Side rails 26 prevent the wheels 36 from going off the edges of the side platforms. The dimensions of the skid 1 elements are matched to the article 34 to be shipped so that before the article's trailing set of wheels 37 reach the front ramp sections 24, the article's leading set of wheels 36 traverse down the rear ramp sections 25, thus lowering the article 34 so that its bottom surface engages and is supported by center platform 16 and the article's rear edge engages elastic member 30 of stop member 28, as illustrated in FIG. 2B. Once in this loaded position, the article 34 is prevented from being moved by platform 16 engaged with the article's bottom surface, and the fact that both sets of wheels 36/37 are straddled on opposing ramp sections 25/24. To further secure the article 34 to the skid 1, bolts, screws, nails, or other fastening anchors can be engaged between article 34 and anchor holes 32. The elastic members 18, 22 and 30 cushion the article 16 from external shocks and vibrations during shipment.

Figure 3B:
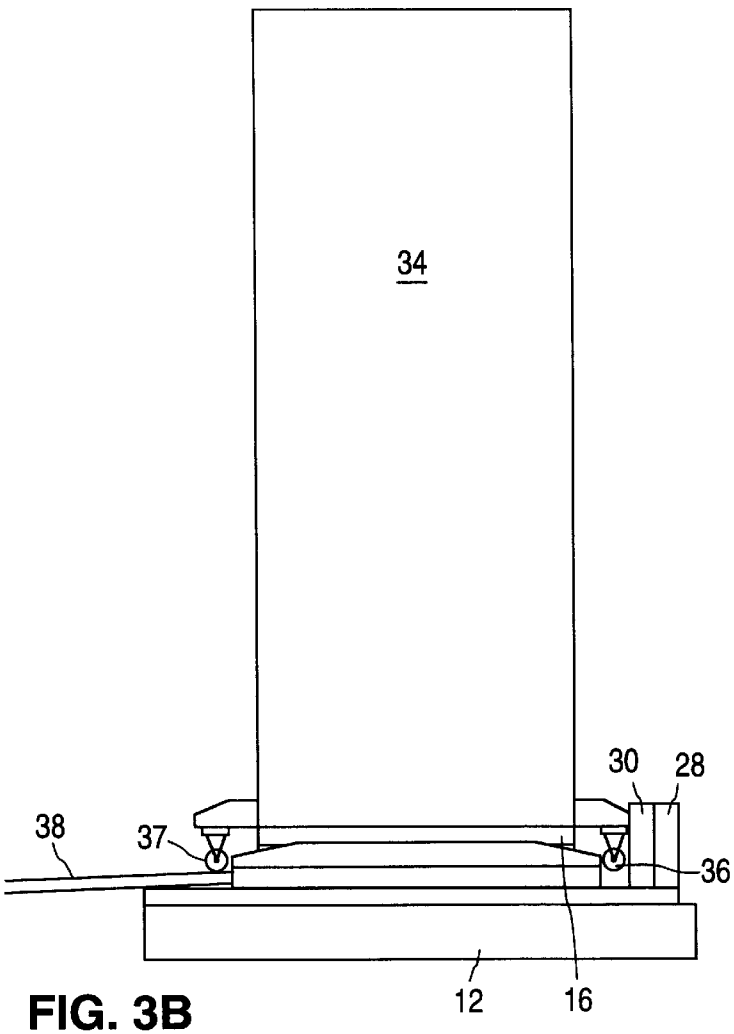
FIGS. 3A–3B are side views illustrating the shipping article being tilted onto the shipping skid of the present invention.
Figure 3A:
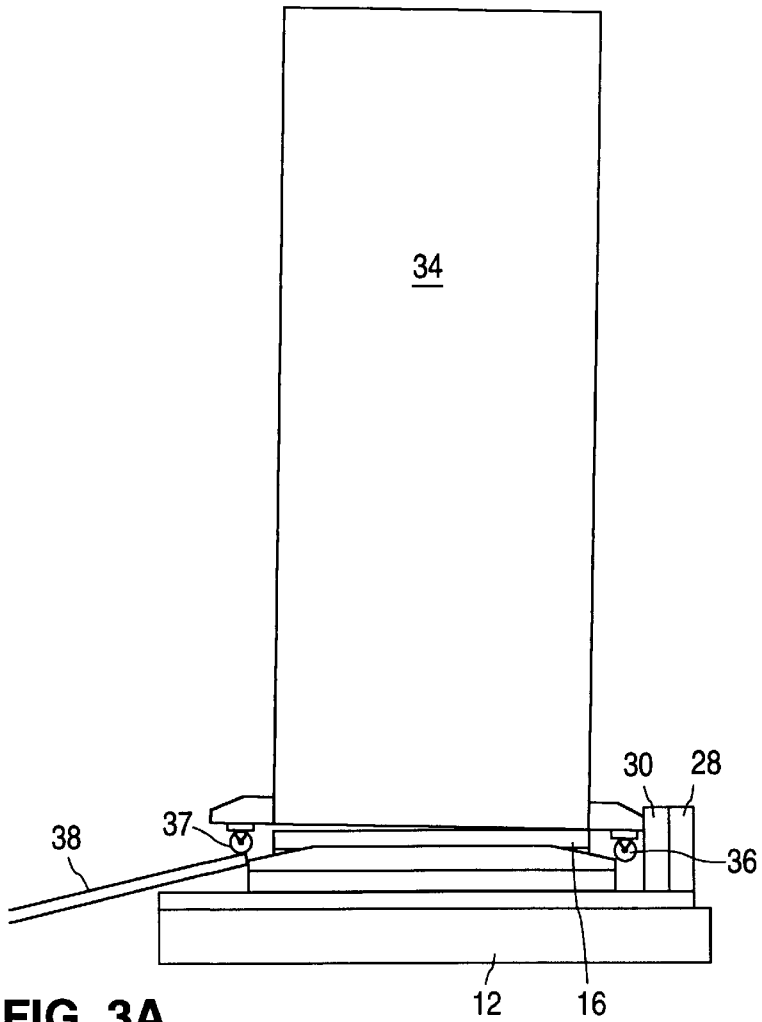

Ideally, the dimensions of skid 1 are such that, during loading, when the leading set of wheels 36 have traversed down the rear ramp sections 25, the trailing set of wheels 37 are still supported by the ramp 38 so that the article is slightly tipped as its bottom surface engages the edge of center platform 16 adjacent rear ramp sections 25 (see FIG. 3A). Then, as the ramp 38 is leveled out to be removed (see FIG. 3B), the trailing set of wheels 37 are lowered down so that the article's entire bottom surface is supported by center platform 16. When the article 34 is to be unloaded from skid 1, the above steps are performed in reverse, where ramp 38 is used to engage wheels 37 and tilt article 34 so that its bottom surface can be lifted off of platform 16 and then slide off the back edge of center platform 16 as the article is wheeled along and off of side platforms 20.

Figure 4:
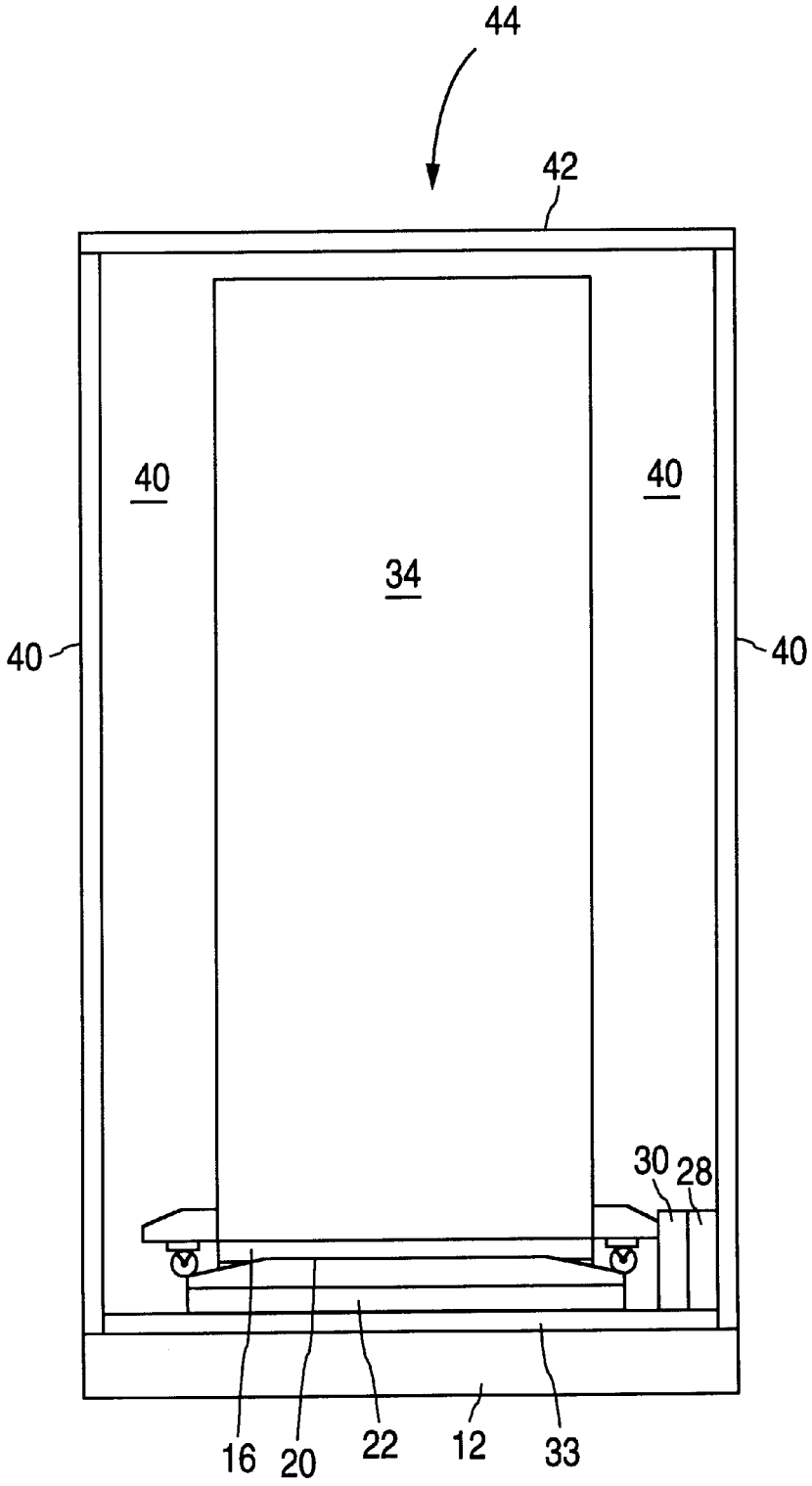
FIG. 4 is a side view of the skid of the present invention with walls and a lid to form a shipping container.

The skid 1 of the present invention can be used in conjunction with four side walls 40 that are removably attached to the base 10 (e.g. with bolts), and a lid 42 attached to the side walls 40, in order to form a shipping container 44, as illustrated in FIG. 4. For convenience, one of the four side walls 40 can be used as the ramp (38) to load and unload the article to/from the skid 1. Alternately, side walls 40 and lid 42 could be integrally formed as an inverted box, such as a corrugated box.

The preferred material for most of the skid 1 components is wood, particle board, wood pulp, plastic, and metal. Elastic members 18, 24 and 30 are preferably made of foam, and are preferably attached to the wooden components with glue.

It is to be understood that the present invention is not limited to the embodiments described above and illustrated herein, but encompasses any and all variations falling within the scope of the appended claims. For example, the shape, size and number of skid members can be varied.

What is claimed is:

1. A shipping skid, comprising:

a base member;

a plurality of skid members attached to a bottom surface of the base member;

a center platform attached to a top surface of the base member;

a pair of side platforms attached to the top surface of the base member with the center platform disposed therebetween, the center platform having an upper surface extending higher above the base member top surface than upper surfaces of the pair of side platforms, wherein each of the side platforms have opposing ends that each have a ramp section that slopes downwardly toward the base member.

2. The shipping skid according to claim 1, wherein:

the center platform includes:

an elastic member attached to the base member, and a center platform member attached to the elastic member; and each of the side platforms includes:

an elastic member attached to the base member, and a side platform member attached to the elastic member.

3. The shipping skid according to claim 1, further comprising:

pair of side rails attached to the pair of side platforms, wherein each side rail extends above the upper surface of the respective side platform.

4. The shipping skid according to claim 1, wherein mounting holes are formed in the center platform.

5. The shipping skid according to claim 1, further comprising:

a plurality of wall members removably attached to the base member; and a lid member removably attached to the wall members, wherein the base member, the plurality of wall members and the lid form an enclosed shipping container.

6. A shipping skid, comprising:

a base member with front and back ends;

a plurality of skid members attached to a bottom surface of the base member;

a center platform attached to a top surface of the base member, the center platform having opposing front and back edges and opposing side edges;

a pair of side platforms attached to the top surface of the base member and each extending along one of the center platform side edges so that the center platform is disposed between the side platforms, the center platform having a raised upper surface that extends higher above the base member top surface than upper surfaces of the pair of side platforms; and each of the side platforms including:

a front ramp section that slopes downwardly toward the base member front end, and a back ramp section that slopes downwardly toward the base member back end.

7. The shipping skid according to claim 6, wherein:

the center platform includes:

an elastic member attached to the base member, and a center platform member attached to the elastic member; and each of the side platforms includes:

an elastic member attached to the base member, and a side platform member attached to the elastic member.

8. The shipping skid according to claim 6, further comprising:

pair of side rails attached to the pair of side platforms, wherein each side rail extends above the upper surface of the respective side platform.

9. The shipping skid according to claim 6, wherein mounting holes are formed in the center platform.

10. The shipping skid according to claim 6, further comprising:

a plurality of wall members removably attached to the base member; and a lid member removably attached to the wall members, wherein the base member, the plurality of wall members and the lid form an enclosed shipping container.

11. The shipping skid of claim 6, further comprising:

a shipping article that is mountable on the center platform, the shipping article having front and rear sets of wheels attached to a bottom surface thereof;

wherein the shipping article is mountable on the raised center platform by rolling the front set of wheels up the front ramp sections, along the top surfaces of the side platforms, and down the back ramp sections before the rear set of wheels roll up the front ramp sections, so that a bottom surface of the shipping article lowers down and engages the raised center platform.

12. The shipping skid according to claim 11, further comprising:

a ramp for rolling the shipping article up onto the side platforms, wherein after the front set of wheels roll down the back ramp sections, the rear set of wheels are supported by the ramp so that changing an angle of inclination of the ramp rocks the bottom surface of the article further onto the raised center platform.

* * * * *